US007749145B2

(12) United States Patent
Allen et al.

(10) Patent No.: US 7,749,145 B2
(45) Date of Patent: Jul. 6, 2010

(54) RHYTHMIC EXERCISE DEVICE AND METHOD OF CONDUCTING AN EXERCISE PROGRAM

(76) Inventors: Karen Joy Allen, 35 Pinecrest Dr., Applegate, CA (US) 95703; Douglas Earl Allen, 35 Pinecrest Dr., Applegate, CA (US) 95703

( * ) Notice: Subject to any disclaimer, the term of this patent is extended or adjusted under 35 U.S.C. 154(b) by 313 days.

(21) Appl. No.: 11/467,516

(22) Filed: Aug. 25, 2006

(65) Prior Publication Data

US 2007/0049135 A1 Mar. 1, 2007

Related U.S. Application Data

(60) Provisional application No. 60/710,821, filed on Aug. 25, 2005.

(51) Int. Cl.
*A63B 71/00* (2006.01)

(52) U.S. Cl. ..... 482/148

(58) Field of Classification Search ..... 482/148; 84/402; 446/419, 421; D17/22
See application file for complete search history.

(56) References Cited

U.S. PATENT DOCUMENTS

| | | | | |
|---|---|---|---|---|
| 2,509,810 | A * | 5/1950 | Core, Jr. | 482/108 |
| 3,843,117 | A * | 10/1974 | Johnson | 482/110 |
| 4,165,671 | A * | 8/1979 | De Bose | 84/402 |
| 4,278,248 | A * | 7/1981 | Kifferstein | 482/74 |
| 4,968,283 | A * | 11/1990 | Montgomery | 446/419 |
| 5,180,350 | A * | 1/1993 | Thomas | 482/40 |
| 5,244,445 | A * | 9/1993 | Amesquita | 482/110 |
| 5,265,514 | A * | 11/1993 | Schertz | 84/422.4 |
| 5,272,951 | A * | 12/1993 | Cohen | 84/402 |
| 5,275,127 | A * | 1/1994 | Leopold | 119/706 |
| 5,505,114 | A * | 4/1996 | Lawson | 84/404 |
| 5,659,143 | A * | 8/1997 | Isackson | 84/402 |
| 5,814,747 | A * | 9/1998 | Ramsell | 84/402 |
| 5,857,946 | A * | 1/1999 | Brown | 482/108 |
| 6,398,694 | B1 * | 6/2002 | Bountourakis | 482/44 |
| 6,512,169 | B1 * | 1/2003 | Santini | 84/402 |
| 6,555,736 | B1 * | 4/2003 | Delosreyes | 84/402 |
| 6,746,247 | B2 * | 6/2004 | Barton | 434/247 |
| 2001/0047715 | A1 * | 12/2001 | Rice | 84/402 |
| 2002/0170282 | A1 * | 11/2002 | Edwards | 56/328.1 |

FOREIGN PATENT DOCUMENTS

WO 2004/096377 * 11/2004

OTHER PUBLICATIONS

Author: Unknown, Date: At least as early as Jun. 26, 2006, Title: Neu! X-Co Pertinent Pages: www.body.-e-motion.de/neuxeo.

* cited by examiner

*Primary Examiner*—Lori Baker
(74) *Attorney, Agent, or Firm*—West & Associates, A PC; Stuart J. West; Charlotte Rodeen-Dickert

(57) ABSTRACT

A hand-held device comprising a central hollow elongated central member partially filled with a granular material, enclosed at both ends by removable and interchangeable end caps. During the range of motion when exercising, the device can place an additional, low-impact load on muscles, while also providing a rhythmic enhancement to a workout.

6 Claims, 8 Drawing Sheets

RHYTHMIC EXERCISE DEVICE AND METHOD OF CONDUCTING AN EXERCISE PROGRAM

CLAIM OF PRIORITY

This application claims the benefit of U.S. Provisional Application No. 60/710,821, filed Aug. 25, 2005, the complete contents of which is hereby incorporated by reference herein.

BACKGROUND

1. Field of the Invention

The present disclosure is for a device that aids in muscle training, strengthening, and development.

2. Background

Physical training with weights improves muscle tone and strength by placing an additional repeated load on the muscle beyond that produced by the mass of the limb itself. Forcing the muscle to work harder with an additional load helps the muscle to develop faster than if exercised without an additional load. Further, the amount of weight can be increased as strength progresses to keep the workout challenging and beneficial.

In aerobic training, adding weights to a person's limbs helps to strengthen muscles while performing a cardiovascular workout. Adding weights can help to work muscles not already being exercised by the cardiovascular activity, as well as make the workout more challenging. For example, a runner can carry hand weights to get an upper-body strength workout while running.

In aerobics, jazzercize, or other similar fitness classes, participants perform a series of choreographed movements, often to music, to improve cardiovascular fitness and strengthen and tone muscles. Holding weights places an additional load on the muscles to make the workout more challenging and further strengthen and tone the muscles. However, holding a dead weight can cause injury with fast motions, particularly at the end of the range of motion for a limb. For example, rapidly extending an arm with a dead weight held in the hand can result in a jolting impact to or hyperextension of the elbow joint, possibly injuring the ligaments supporting that joint, as well as potentially straining the other muscles and tendons of the arm and shoulder.

During exercise, listening to music helps with pace and rhythm, as well as provides motivation. Although a participant in an aerobics class, for example, can hear the music playing and move accordingly, having a personal rhythm device can keep a person more in touch with the beat of the music. Holding a shaker or other device that the user must move in time with the music provides a kinesthetic connection to the music.

What is needed is a device that allows users to place an additional, low-impact load on a muscle, while providing a rhythmic benefit while exercising.

DETAILED DESCRIPTION

Figure 1:
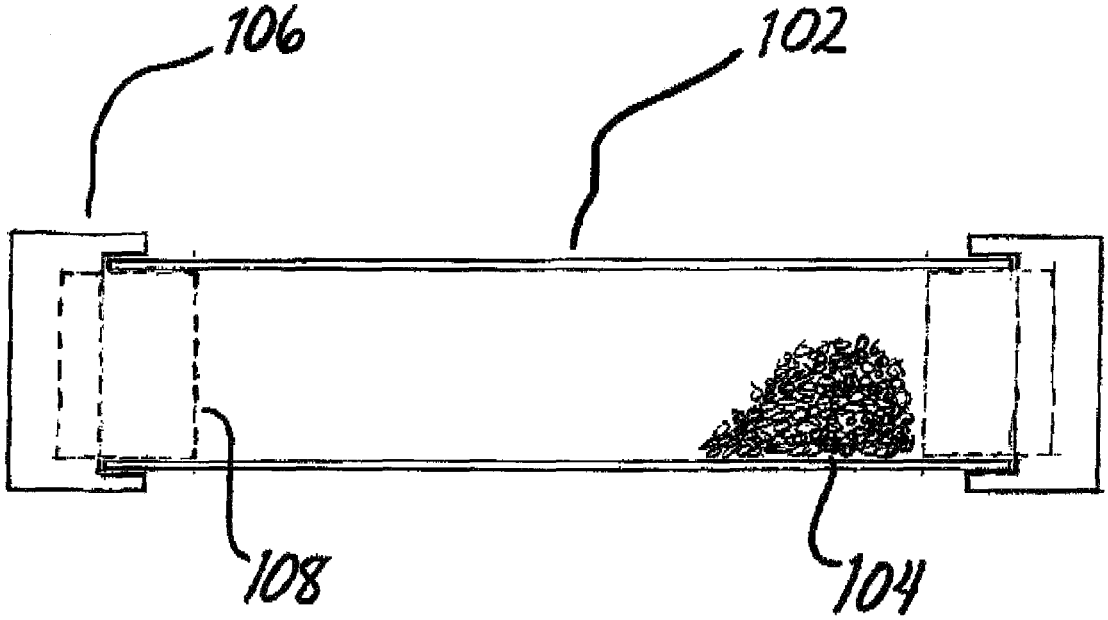
FIG. 1 depicts a side view of an embodiment of the present device.
Figure 2:
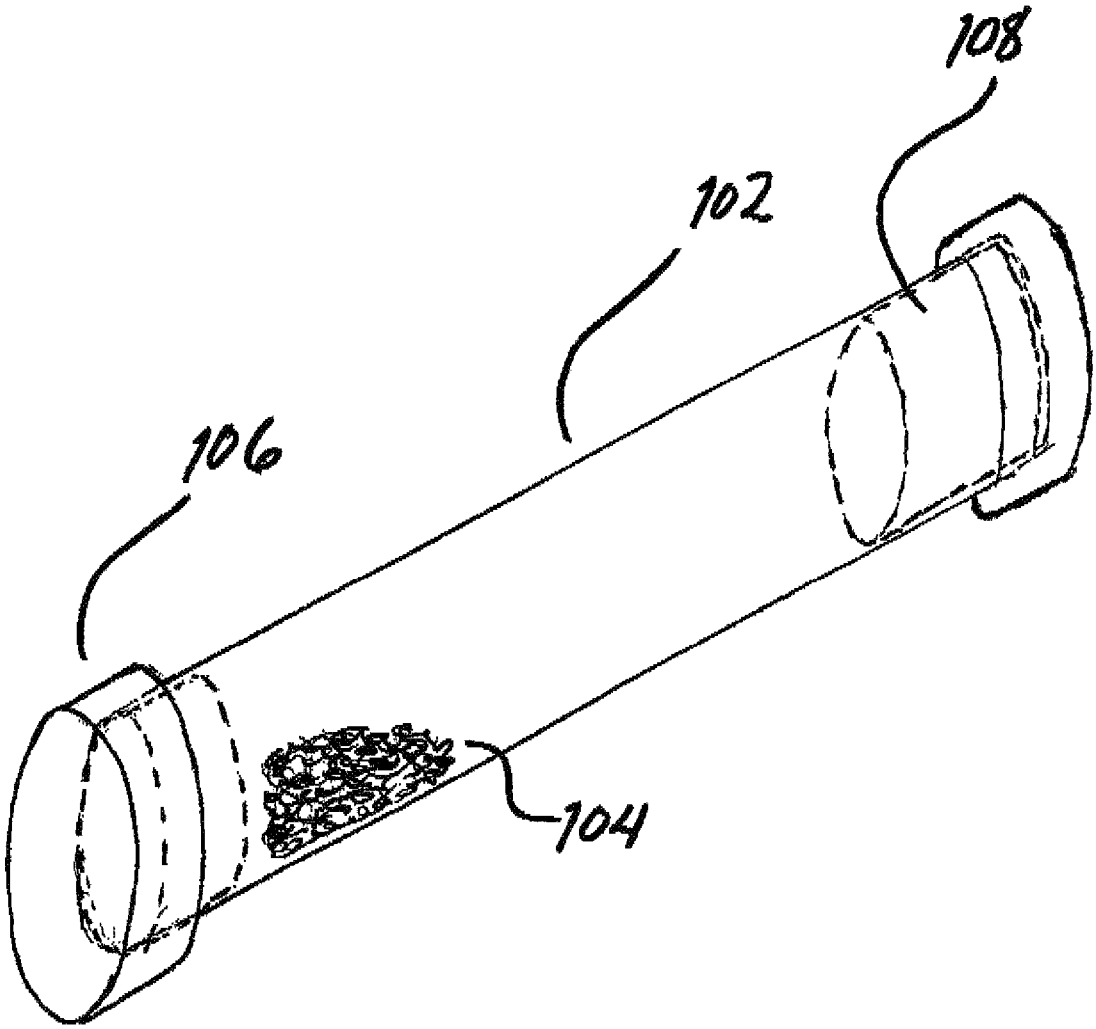
FIG. 2 depicts a perspective view of an embodiment of the present device.

FIG. 1 depicts an embodiment of the present device. An elongated hollow central elongated member 102 can be partially filled with a quantity of granular material 104. End members 106 can close the open ends of the hollow central elongated member 102. Stoppers 108 of cross-sectional dimensions and cross-sectional area slightly less than that of the interior cross-sectional dimensions and cross-sectional area of the hollow region of the central elongated member 102 and of length less than half the length of the hollow central elongated member 102 can be substantially aligned with the longitudinal axes of the hollow central elongated member 102 and the end members 106.

The central elongated member 102 can be made of plastic, rubber, polymer, metal, or any other known and/or convenient material. The material can have an inherent texture to improve comfort and/or grip, or in some embodiments an additional covering or coating can provide these properties. The central elongated member 102 can be substantially straight, as shown in FIG. 1, or curved to any known and/or convenient radius. Further, the cross section of the elongated central elongated member 102 can be circular, as shown in FIG. 1, or any known and/or convenient geometry.

The granular material 104 can be any known and/or convenient material, such as, but not limited to, polymers, plastics, or metals. The volume of the quantity of granular material can be less than 25% than that of the volume of the hollow region of the central elongated member 102 with the stoppers 108 in place.

In some embodiments, as shown in FIG. 1, the end members 106 can be caps that cover the open ends of the hollow central elongated member 102. However, the end members can be any known and/or convenient configuration to effectively close the open ends of the hollow central elongated member 102. They can be permanently coupled with the hollow central elongated member 102, thereby permanently sealing it. In other embodiments, they can be removably coupled by a screw coupling, friction fit, magnetic coupling, or any other known and/or convenient mechanism. Further, the end members 106 can be made of plastic, rubber, polymer, metal, or any other known and/or convenient material.

In some embodiments, the stoppers 108 can be attached to the end members 106 such that when the end members 106 are coupled with the ends of the central elongated member 102 the stoppers 108 set into the hollow region of the central elongated member 102, thereby making the length of the hollow region less than that of the central elongated member 102. The stoppers 108 can be made of plastic, rubber, polymer, metal, or any other known and/or convenient material.

Figure 3:
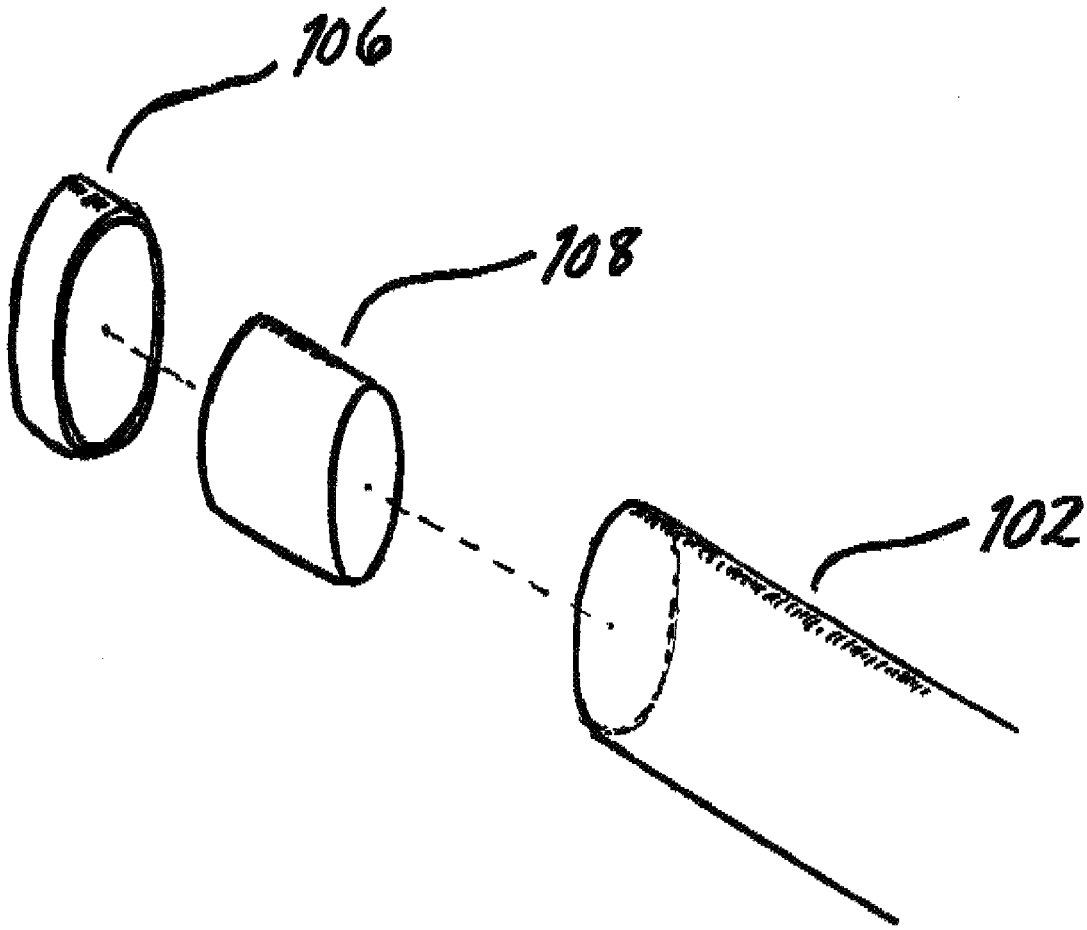
FIG. 3 shows another embodiment of the present device with an end cap removed.

FIG. 3 shows another embodiment of the present device, wherein at least one of said end members 106 can be removable. Further, in some embodiments, the stoppers 108 can also be removable.

Figure 3A:
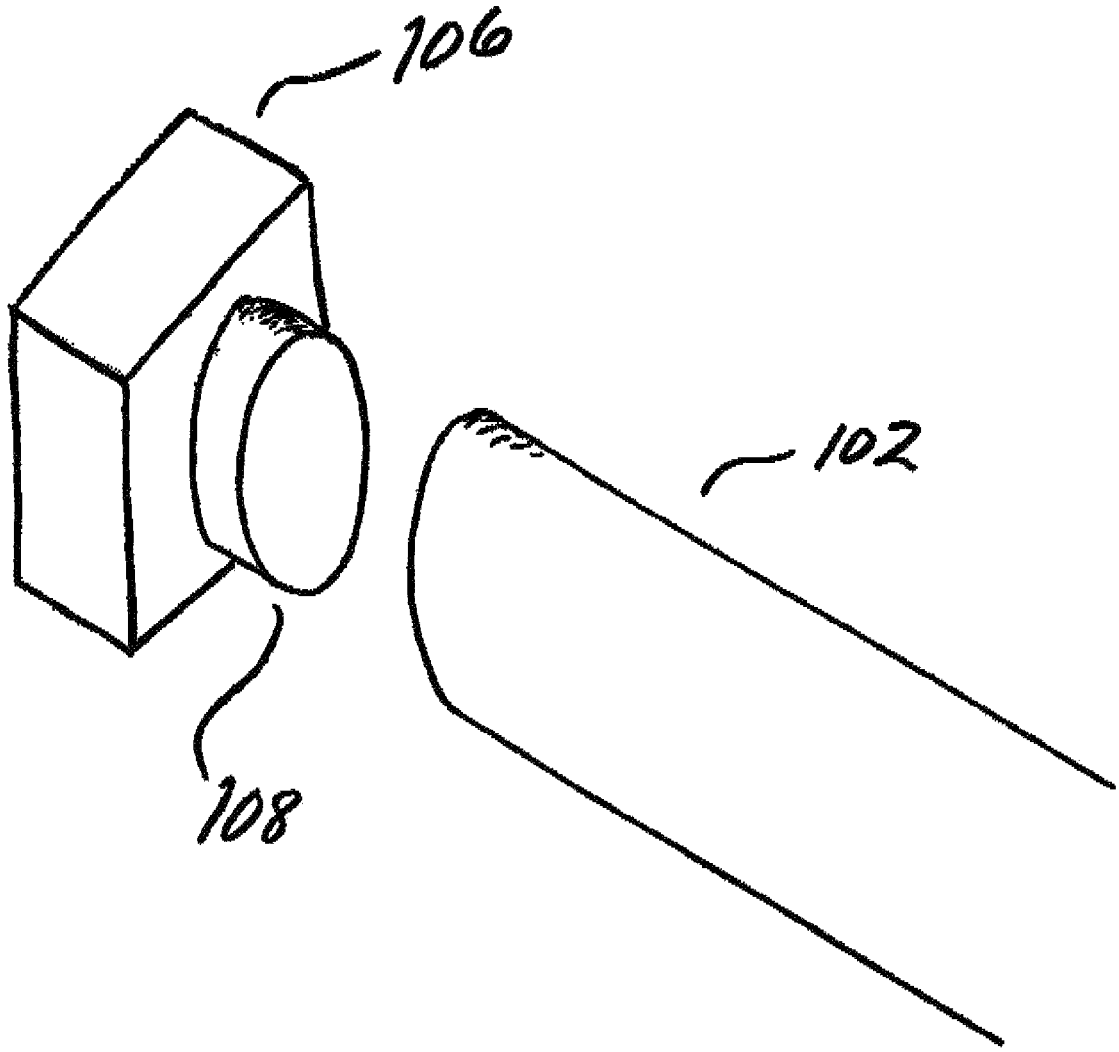
FIG. 3*a* shows an alternative embodiment of an end cap having a different cross-section than that of the central elongated member.

FIG. 3*a* shows another embodiment of an end member 106, wherein it has a substantially square-shaped cross-section. In other embodiments, the end members 106 can have any known and/or convenient polygonal cross sections that may or may not be different from the cross section of the central elongated member 102. Further, the end members 106 can be produced in different weights and can be made of plastic, rubber, polymer, metal, or any other known and/or convenient material.

In embodiments having removable end members 106, said end members 106, stoppers 108, and the granular material 104 can be replaced by additional interchangeable components. End members 106 can be replaced by alternative interchangeable end members 106 having different colors, weights and/or shapes. Stoppers 108 can be replaced by interchangeable stoppers 108 having different lengths. The granular material 104 can be replaced with an alternate granular material 104 having a different density, thereby changing the weight of the granular material 104 within the hollow central elongated member 102.

Figure 4:
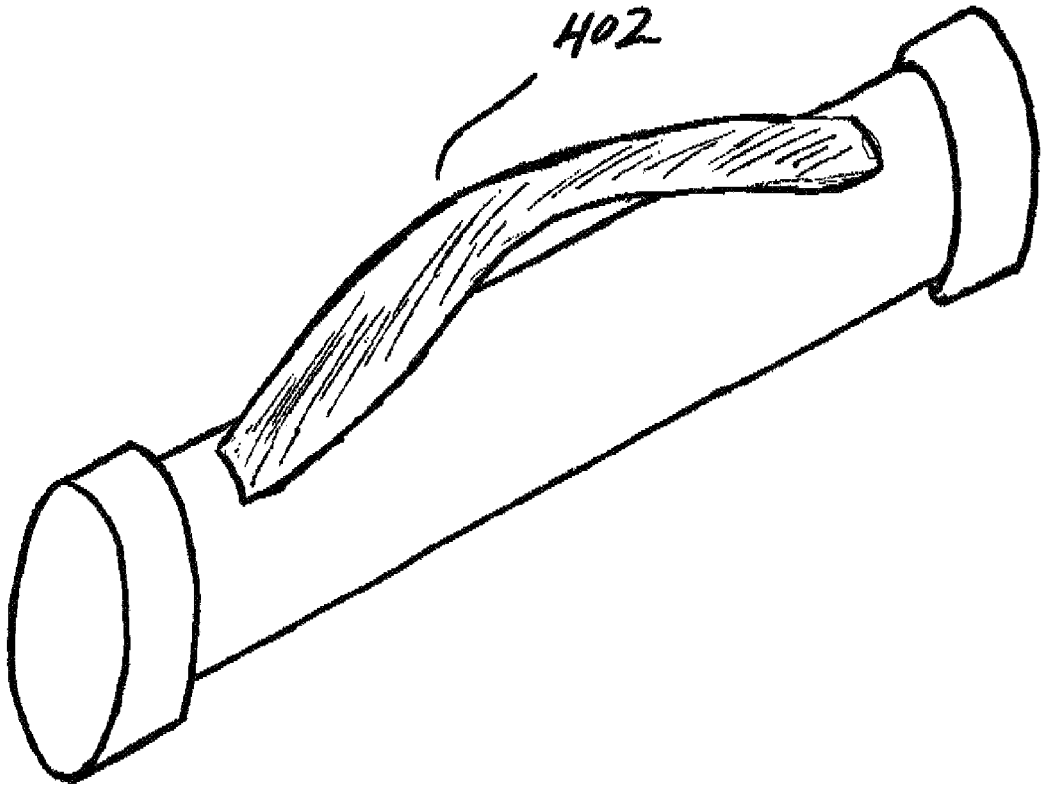
FIG. 4 shows an alternative embodiment of the present device with an additional member to secure the device to a person's extremity.

FIG. 4 shows another embodiment of the present device including a securing member 402 affixed to the exterior surface of the hollow central elongated member 102. In some embodiments, a securing member 402 can be a fixed or adjustable strap. A securing member 402 can also be any known and/or convenient mechanism for securing the present device to a person's limb or extremity. In some embodiments, a securing member 402 can be a loop or tether affixed substantially near one end of the hollow central elongated member 102. A securing member 402 can be permanently or removably attached to the hollow central elongated member 102.

Figure 5:
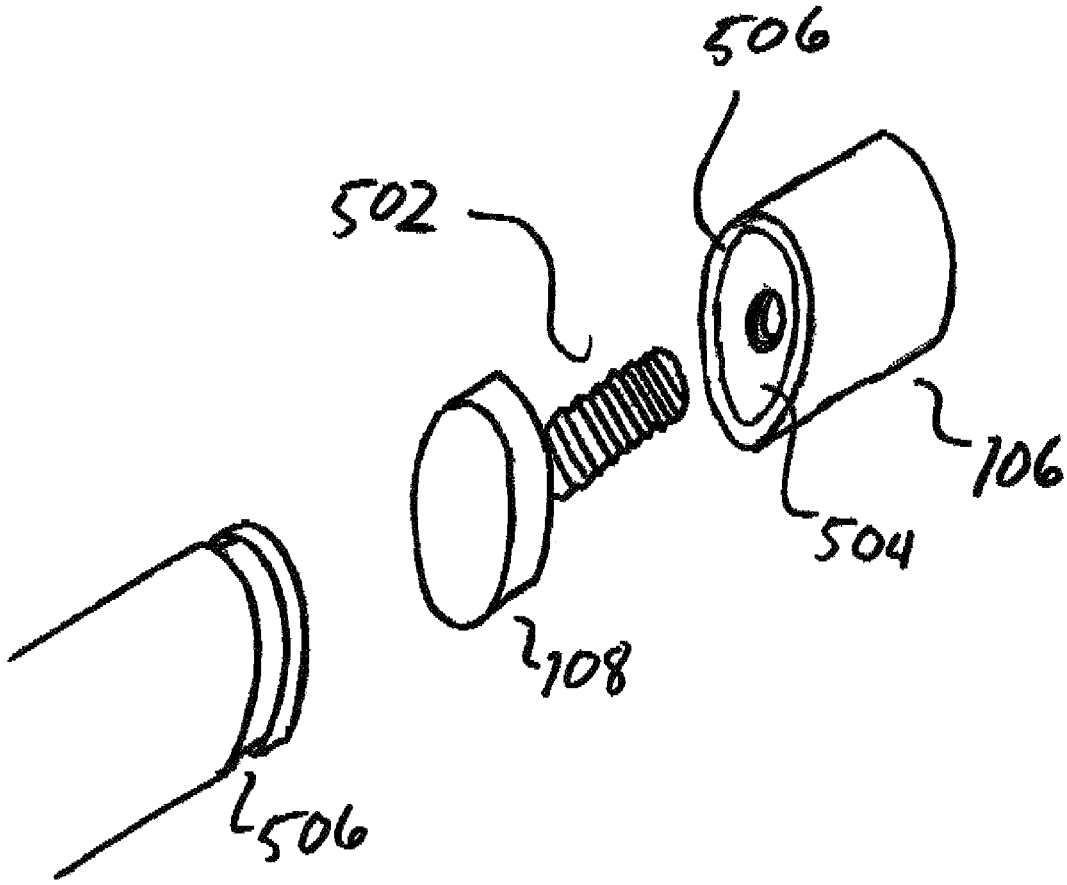
FIG. 5 shows an alternative embodiment of the present device with an adjustable stopper mechanism.
Figure 5A:
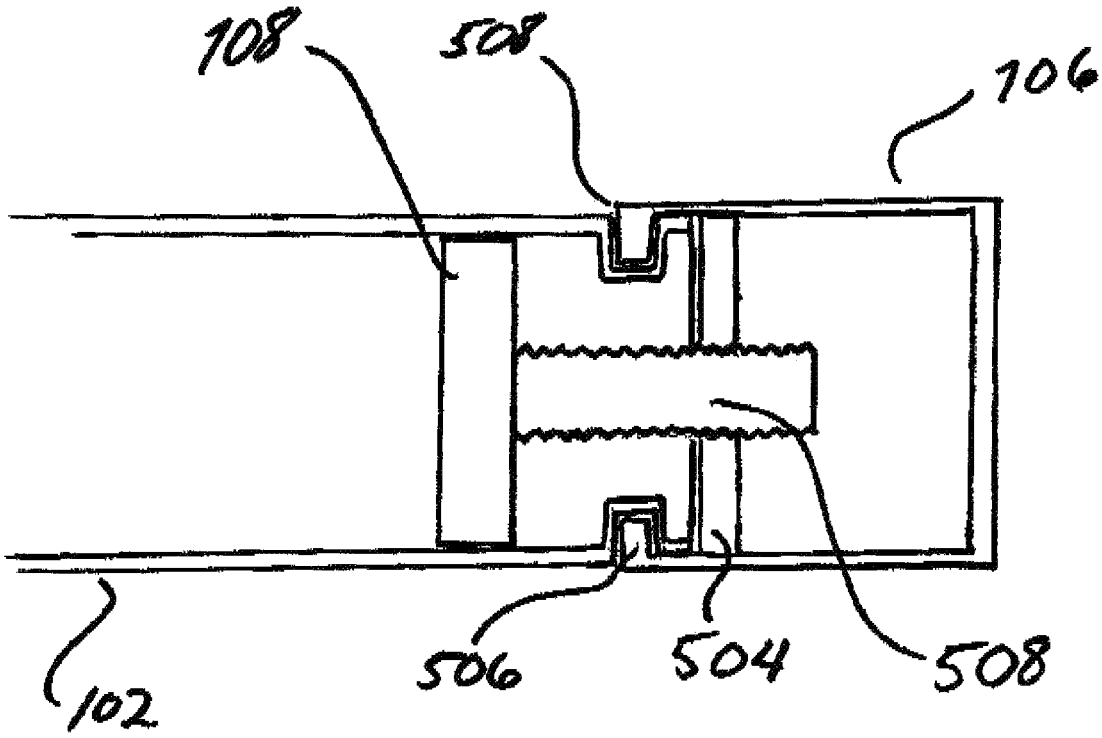
FIG. 5*a* depicts a side cutaway view of the embodiment shown in FIG. 5.

In some embodiments, the present device can have adjustable stoppers 108. As shown in FIG. 5, the end members 106 can be rotated to move the stoppers along the longitudinal axis of the central elongated member 102. The stopper 108 can be affixed to a threaded shaft 502 located substantially along the central axis of the stopper 108. A disk having a threaded central hole 504 can be affixed to the open end of an end member 106 proximal to an end of the central elongated member 102. An end member 106 can have an inward-turning turning flange 506 on said open end of an end member. The central elongated member 102 can have a circumferential groove 508 located substantially near an end of the central elongated member 102.

When assembled, the stopper 108 sits inside the hollow portion of the central elongated member 102, while the threaded shaft is coupled with the threaded hole in the disk 504. An end member 106 is coupled with the central elongated member 102 such that the flanged edge of the end member 106 sits in the circumferential groove 508. Rotating an end member 106 about the central axis of the device rotates a disk 504 such that the threaded hole and shaft coupling translates the rotational motion to longitudinal motion of a stopper 108 via the threaded shaft In other embodiments, a ratchet or any other known and/or convenient mechanism can lock said end member 106 in place. The coefficient of friction between the lateral edges of a stopper 108 and the interior walls of the hollow central elongated member 102 can be such that rotational motion of a stopper 108 is prevented. Therefore, as an end member 106 is rotated, the corresponding stopper 108 can be adjusted to change the length of the interior hollow region of the central elongated member 102. Although shown in FIG. 5 with a screw mechanism to adjust the stopper 108 position within the central elongated member 102, any other known and/or convenient mechanism can be used to adjust the stopper 108 position.

In operation of one embodiment, a user grips the central elongated member 102. As the user moves her arms in flexion and extension, the granular material 104 shifts within the hollow portion of the central elongated member 102 in the direction of the motion. The mass of the granular material 104 places an additional mechanical load on the muscles involved in the motion. As the device accelerates and decelerates through the range of motion, the granular material 104 travels down the length of the hollow portion of the central elongated member 102. The granular material 104 impacts the end of a stopper 108 that has been inserted into the hollow portion of the central elongated member 102. The force of this impact creates a reaction force that is exerted on the muscles, thereby increasing the mechanical load experienced by these muscles. Increasing the mechanical load on the muscles during the range of motion can enhance the challenge of the workout and improve muscle development. In other embodiments, a user could attach the device to a foot or other part of the leg while participating in a lower-body workout to achieve the same effect.

The impact force, and subsequent reaction force exerted on the muscles, is created by the mass of the granular material 104 decelerating when it impacts the end of a stopper 108. However, in contrast to a dead weight, which all travels at the same speed and decelerates at the same time, the particles of the granular material 104 decelerate differently, thereby spreading out the time of impact of the total mass of granular material 104. By spreading out the time of impact, the reactive force, and therefore the additional mechanical load exerted on the muscles is not experienced as a jolt, but as a gentler force. This can decrease the likelihood of injury to muscles and connective tissues experiencing the increased mechanical load.

In embodiments with removable end members 106, a user can change the end members 106, stoppers 108, and/or the granular material 104 to customize the device to an individual's exercise needs. Increasing or decreasing the weight of the end members 106 or the stoppers 108 can provide more or less resistive force to the muscles. Changing the length of the stoppers 108 to vary the length of the hollow portion of the central elongated member, as well as changing the density and/or volume of the granular material 104 can alter the impact dynamics of the granular material and the resulting reaction force exerted on the muscle. End members 106 can also be interchanged for different colors to provide aesthetic appeal. In an embodiment with a substantially transparent or translucent hollow central elongated member 102, different colors of stoppers 108 and/or granular material 104 can provide further aesthetic enhancement.

In addition to the mechanical load placed on the muscles, the movement of the granular material 104 within the hollow central elongated member 102 can also produce a rhythmic sound in response to the user's movements. The sound component of the present device can strengthen the user's connection to the music, which can provide motivation and pacing during the workout. Further, the sound can provide auditory feedback to the user regarding the force and tempo of her motions and help her to keep in sync with the music. Alternatively, in other embodiments a user can use the device in the absence of music to create her own rhythm sounds during a workout.

Figure 6:
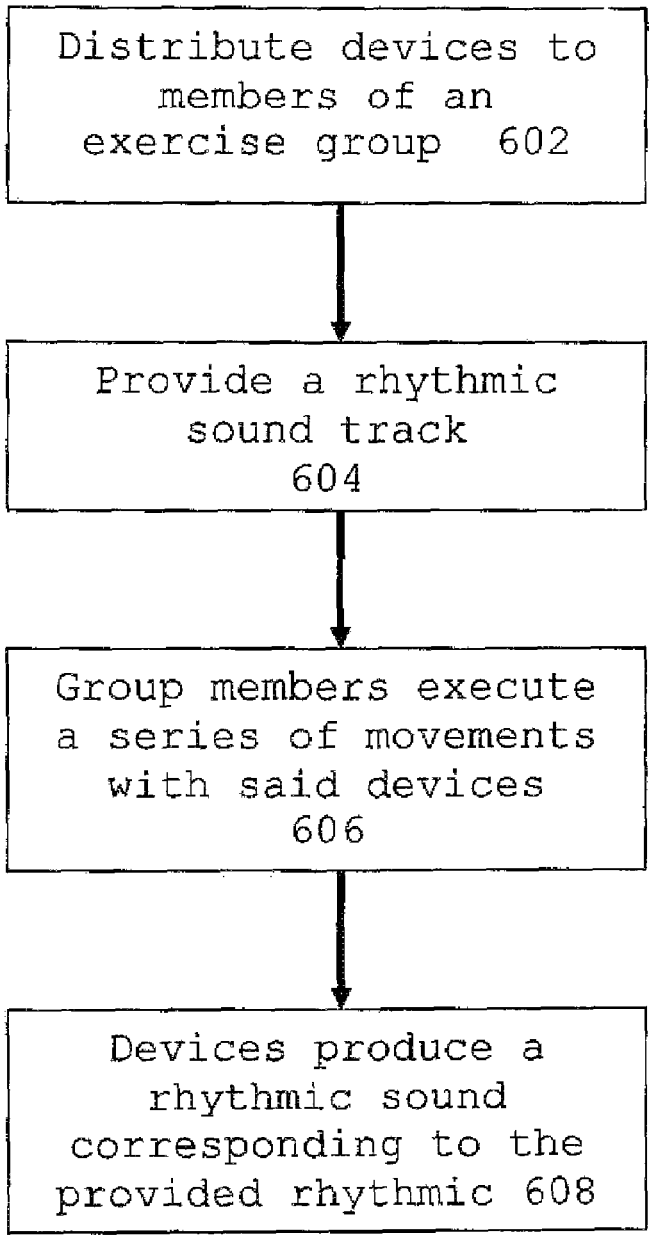
FIG. 6 shows a method for conducting a group exercise activity with embodiments of the present device.

As shown in FIG. 6, embodiments of the present device can also create a rhythmic group exercise experience. Embodiments of the present device can be distributed to members of a group 602. Music can be provided for the group to follow and to which the group performs a series of movements 604. Movement of embodiments of the present device 606 during the exercise can produce a group rhythmic sound, which can help to keep the group members in sync, as well as provide a motivational and pacing beat 608. Alternatively, exercise can be conducted to produce syncopated rhythms and beats among sub-groups or individual members of the group 608.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims.

What is claimed is:

1. An exercise device, consisting of:

a substantially straight, central elongated member, having a hollow interior region and an exterior surface and having at least one open end;

end caps having an interior surface and an exterior surface;

adjustable stoppers having cross-sectional dimensions and cross-sectional area slightly less than that of the central elongated hollow member; and a quantity of freely moving granular material;

wherein said end caps are connected to the open ends of the central elongated member and said stoppers are in the interior region of the hollow member when the end caps are connected to the open ends of the central elongated member and said stoppers having a threaded shaft affixed to the stopper substantially along the central axis of the stopper;

wherein said quantity of granular material resides in the interior region of said central elongated member, and the volume of the granular material is less than 25% of the volume of the interior region with the stoppers in place;

wherein at least one of said end caps is removably attached to at least one of the open ends of said central elongated member;

wherein said end caps are removably attached to said stoppers and replaceable with another stopper of greater or lesser length;

wherein said end caps are replaceable with another end cap of greater or lesser weight;

and wherein at least one end cap is rotationally coupled to an open end of said central elongated member and said threaded shaft located substantially along the central longitudinal axis of a said stopper extends into the hollow interior region of said central elongated member and said cap;

and a disk having a threaded hole to receive said threaded shaft located substantially along its central longitudinal axis, wherein said disk is affixed substantially perpendicularly to the interior surface substantially near the open end of said end member.

2. The device of claim 1, wherein said quantity of granular material is replaceable with substantially the same volume of granular material having a greater or lesser density.

3. The device of claim 1, wherein said central elongated member has a cross-section selected from the group consisting of: circular, .elliptical, polygonal.

4. The device of claim 1, wherein said central elongated member is curved.

5. The device of claim 1, further comprising texturing on the exterior surface of said elongated member.

6. The device of claim 1, further comprising a securing member attached to the exterior surface of said central elongated member.

* * * * *